United States Patent [19]

Katsuno et al.

[11] Patent Number: 4,562,335

[45] Date of Patent: Dec. 31, 1985

[54] THERMAL FIXING ROLL FOR ELECTROGRAPHIC PROCESSING

[75] Inventors: Ryuji Katsuno; Toshihiko Tsuda, both of Kanagawa, Japan

[73] Assignee: Fuji Xerox Co., Ltd., Tokyo, Japan

[21] Appl. No.: 569,139

[22] Filed: Jan. 9, 1984

[30] Foreign Application Priority Data

Jan. 7, 1983 [JP] Japan ..... 58-434

[51] Int. Cl.[4] ..... G03G 15/20

[52] U.S. Cl. ..... 219/216; 355/3 FU

[58] Field of Search ..... 219/216, 469, 470, 471; 355/3 FU; 432/228, 60

[56] References Cited

U.S. PATENT DOCUMENTS

| | | | |
|---|---|---|---|
| 3,731,358 | 5/1973 | Artl | 432/60 |
| 3,809,854 | 5/1974 | Sanders | 432/60 |
| 3,813,516 | 5/1974 | Kudsi | 219/216 |
| 4,013,871 | 3/1977 | Namiki | 219/469 |
| 4,360,566 | 11/1982 | Shimizu | 219/469 |

FOREIGN PATENT DOCUMENTS

| | | | |
|---|---|---|---|
| 125139 | 4/1977 | German Democratic Rep. . | |
| 55-17944 | 2/1980 | Japan | 219/469 |
| 57-109855 | 7/1982 | Japan . | |
| 58-16273 | 1/1983 | Japan | 355/3 FU |

*Primary Examiner*—C. L. Albritton
*Assistant Examiner*—Teresa J. Walberg
*Attorney, Agent, or Firm*—Sughrue, Mion, Zinn, Macpeak and Seas

[57] ABSTRACT

A thermal fixing roll used in electrographic processing in which a rough metallic cylindrical core (2) contains an internal heater (H) and has a heat-resistant layer (3) covering the outer surface thereof. The heat-resistant layer is silicone rubber mixed with silicon carbide.

7 Claims, 1 Drawing Figure

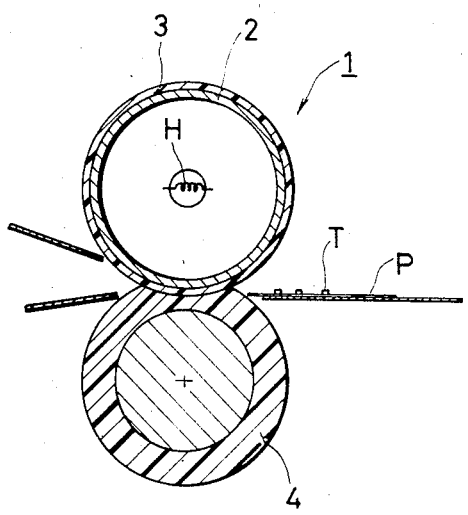
3
2
1
H
T
P
4

THERMAL FIXING ROLL FOR ELECTROGRAPHIC PROCESSING

BACKGROUND OF THE INVENTION

This invention relates to a fixing roll used in equipment such as an electrographic copying machine, a facsimile machine, or a printer which utilizes an electrographic process.

In a general electrographic process, a toner image is first formed on a photo-sensitive member and is then transferred by a transferring unit onto a recording medium such as a recording sheet. Thereafter, when necessary, the toner image thus transferred is fixed onto the recording medium, to provide a desired copy.

Methods known in the art for fixing toner images are the methods of heat-type fixing, pressure-type fixing, and solvent-type fixing. The heat-type fixing method is extensively employed. In the heat-type fixing method, toner is melted by heat so that it sticks onto a recording medium. The heat-type fixing method is further divided into a hot air-type fixing method, a heat roll-type fixing method, and others. Of these, the heat roll-type fixing method is most generally employed. The heat roll-type fixing method uses a thermal fixing roll 1, illustrated in cross-section in the FIGURE and a pressure roll 4 which is pushed against the roll 1 under a certain pressure. The thermal fixing roll 1 comprises a cylindrical rough core 2, a heater H placed within the core 2, and a heat-resistant layer 3 formed on the outer wall of the core 2. A sheet P having a toner image T is passed through the rolls 1 and 4, so that the toner image T is fixed onto the sheet P by the conductive heat of the thermal fixing roll 4.

The heat-resistant layer (or heat-resistant elastic layer) 3 of the thermal fixing roll 1 must be resistant not only against the effects of heat but also against pressure, and should be made of a material to which toner barely adheres. Generally, the heat-resistant layer 3 is made of fluororesin (polytetrafluoroethylene resin), HTV (high temperature vulcanization) silicone rubber, or RTV (room temperature vulcanization) silicone rubber.

When the heat-resistant layer 3 is formed by applying fluororesin to the core 2, its thickness is generally of the order to several microns ($\mu$m) to several tens of microns. When it is made of silicone rubber, its thickness is about 300 $\mu$m. Thus, a heat-resistant layer of silicone rubber has substantial thickness. The thermal conductivity of silicone rubber is $4\times10^4$ cal/cm sec °C., which is appproximately equal to that of an asbestos sheet or cork plate. Accordingly, it takes a relatively long time to increase the surface temperature of the thermal fixing roll 1 to a predetermined value. As a result the thermal fixing roll having a heat-resistant layer of silicone rubber is not practical. Furthermore, since the thermal conductivity of silicone rubber is low, it takes a long time to restore the surface temperature of the roll which has decreased because of the passage of a sheet P. Accordingly, if the thermal fixing roll 1 is used continuously with a heater H of low heat rating, the surface temperature of the roll 1 is decreased to the extent that the toner image is not satisfactorily fixed.

In order to overcome this difficulty, metal powder or metal oxide powder is often mixed with the silicone rubber, to increase the thermal conductivity of the heat-resistant layer 3. However, if a fixing unit employs a heat-resistant elastic layer 3 which is made of a mixture of silicone rubber and metal powder or metal oxide powder (such as alumina or iron oxide red), the following difficulty arises. When the fixing unit is repeatedly used, toner is accumulated on the surface of the thermal fixing roll. As a result, the toner image on a sheet passing the rolls is transferred onto the thermal fixing roll and is transferred therefrom onto the following sheet. That is, a so-called "offset phenomenon" is liable to take place, and the service life of the thermal fixing roll 1 is thereby reduced. A toner offset preventing solution is sometimes used to overcome this problem.

SUMMARY

An object of the invention is to provide a thermal fixing roll with which toner images are fixed satisfactorily and the offset phenomenon scarcely occurs.

The invention provides a thermal fixing roll in which a heat-resistant elastic layer covering the outer wall of a cylindrical rough core is made of silicone rubber mixed with silicon carbide.

BRIEF DESCRIPTION OF THE DRAWING

The FIGURE is a cross-sectional view of a heat roll-type fixing unit of this invention as used in electrographic processing.

DETAILED DESCRIPTION OF THE INVENTION

Referring now to the FIGURE, an example of the invention will be described. The heat-resistant elastic layer 3 of a thermal fixing roll 1 according to the invention is made of silicone rubber mixed with silicon carbide (SiC) powder. Silicon carbide has a considerably high degree of hardness, suffers little from degradation in the presence of heat, has a high thermal conductivity, and does not react with other elements at high temperature. Because of these properties, silicon carbide is often used as an abrasive, wear-resistant material, and as a refractory material. It has been found through experiments that silicone rubber mixed with silicon carbide is most suitable for the heat-resistant elastic layer 3.

Before the results of the experiments with the invention are presented, a method of manufacturing the thermal fixing roll according to the invention will be described.

First, raw silicone rubber (polymer) is mixed with a filler (such as silica powder), a dispersion accelerator for the filler (such as silicone resin), and a heat-resistant agent. The resultant mixture is kneaded with two rolls or a kneader which is generally used in the rubber industry. For this invention, while the kneading operation is being carried out, a vulcanizing agent (such as organic peroxide or sulfur) and silicon carbide powder are added to the mixture. The amount of silicon carbide powder to be added is 50 to 500 parts by weight, preferably 50 to 200 parts by weight, with respect to 100 parts by weight of raw silicone rubber. Addition of the silicon carbide powder makes the kneading operation rather difficult. Therefore, it is effective to add dimethyl silicon oil as a processing oil. If it is required to color the thermal fixing roll, $Fe_2O_3$ or $TiO_2$ is also added to the mixture.

A sheet is made of the rubber compound which has been prepared by the kneading operation. The core 2 is generally made of aluminum, aluminum alloy, copper, copper alloy or steel. The outer surface of the core 2 is knurled or roughened. Primer or adhesive is applied to the surface of the core 2. The rubber sheet thus made is then wound onto the core 2. The core 2 covered with the rubber compound sheet is then placed into a split metal mold and is shaped by applying heat and pressure. Alternatively, the sheet having the rubber-silicon-carbide mixture is tightened by winding it around the core 2 with a piece of cloth or the like.

A thermal fixing roll 1 with a heat-resistant elastic layer 3 of silicone rubber mixed with silicon carbide is provided according to the above-described manufacturing method. Comparison tests were performed to compare the reproduction characteristic of a thermal fixing roll using this invention in a fixing unit against other types of thermal fixing rolls. The heat-resistant layers that were compared were that of this invention, silicone rubber mixed with alumina ($Al_2O_3$), a silicone rubber mixed with iron oxide red ($Fe_2O_3$), and silicone rubber that had not been mixed with metal oxide in order to improve the thermal conductivity.

The materials of the heat-resistant elastic layers used in the tests are described more fully as follows:

(1) Example of the Invention

Thermal vulcanization type HTV silicone rubber of 100 parts by weight is mixed with silicon carbide of 120 parts by weight. Dimethyl silicone oil is used for kneading.

(2) Comparison Example 1

Thermal vulcanization type HTV silicone rubber of 100 parts by weight is mixed with alumina of 170 parts by weight. Dimethyl silicone oil is used for kneading.

(3) Comparison Example 2

Thermal vulcanization type HTV silicone rubber of 100 parts by weight is mixed with iron oxide red of 220 parts by weight. Dimethyl silicone oil is used for kneading.

(4) Comparison Example 3

Thermal vulcanization type HTV silicone rubber is used without further processing.

Fixing units using thermal fixing rolls with the various heat-resistant layers 3 were subjected to reproduction tests in an electrographic copying machine. The test counted how many copies were obtained before the occurrence of the offset phenomenon produced poor copies. In the test, the thermal conductivities of the above-described silicone rubbers mixed respectively with silicon carbide, alumina and iron oxide red were made equal at $2.0\times10^3$ cal/cm sec °C. so that the surface temperatures of the thermal fixing rolls reached a predetermined value after a constant temperature rise time.

The reproduction test results are as indicated in the following Table 1.

TABLE 1

| | Example of the invention | Comparison Example 1 | Comparison Example 2 | Comparison Example 3 |
|---|---|---|---|---|
| Rise time (sec) | 70 | 70 | 70 | 150 |
| Number of copies obtained before offset occurs | 55,000 | 30,000 | 20,000 | 50,000 |

As is apparent from the above-described reproduction test results, the same thermal conductivity ($2.0\times10^3$) cal/cm sec °C.) can be obtained by adding silicon carbide smaller in quantity than alumina and iron oxide red to the silicone rubber. The temperature rise time in this case is approximately half of that of Comparison Example 3. As is clear from the comparison of the numbers of copies, the service life of the thermal fixing roll in the example of the invention is about twice as long as that of Comparison Example 1 or 2, and is somewhat longer than in Comparison Example 3. However, Comparison Example 3 manifests a significantly longer rise time.

In the example of the invention, toner images were satisfactorily fixed, and no copies were creased. After the reproduction test, the surface of the thermal fixing roll 1 was examined. The inspection showed that both ends of the roll which are contacted by the edges of a recording sheet were scarcely recessed. That is, it was found that the thermal fixing roll was excellent in resistance to deformation.

The above-described reproduction test was carried out with an electrographic copying machine which has a fixing unit which uses no toner offset preventing solution. To extend the comparison, reproduction tests were carried out with a fixing unit using a toner offset preventing solution, which employed a thermal fixing roll whose heat-resistant elastic layer 1 was made of 100 parts of silicone rubber mixed with 20 parts of silicon carbide by weight. In this test, 120,000 copies were obtained before pieces of rubber peeled off the surface of the heat-resistant elastic layer. In contrast, in tests using the conventional thermal fixing roll, the number of copies obtained before the rubber began to peel off was 70,000. Thus, it was determined that the thermal fixing roll provided by this invention offers considerably lengthened service life.

As is apparent from the above description, in the thermal fixing roll used for electrographic processing and built according to the invention, the heat-resistant elastic layer formed on the outer wall of the rough cylindrical core is made of silicone rubber mixed with silicon carbide. As a result, the heat-resistant elastic layer has excellent thermal conductivity, thus reducing the temperature rise time of the thermal fixing roll. In comparison with the conventional thermal fixing roll, the thermal fixing roll of this invention can be used longer before the fixing operation becomes unsatisfactory. In addition, the thermal fixing roll of this invention has a long service life before the offset phenomenon takes place or before the heat-resistant elastic layer is mechanically damaged.

We claim:

1. An electrographic processing thermal fixing roll, comprising:

a cylindrical core (2); and a heat-resistant elastic layer (3) substantially covering an outer cylindrical surface of said core, said layer comprising a mixture of silicone rubber and silicon carbide.

2. An electrographic processing thermal fixing roll, as recited in claim 1, wherein said core is rough.

3. An electrographic processing thermal fixing roll, as recited in claim 2, further comprising a heater (H) disposed within said rough core.

4. An electrographic processing thermal fixing roll, as recited in claim 1, wherein the mixture comprises 100 parts by weight of silicone rubber and 50 to 500 parts by weight of silicon carbide powder.

5. An electrographic processing thermal fixing roll, as recited in claim 4, wherein the mixture comprises 100 parts by weight of silicone rubber and 50 to 200 parts by weight of silicon carbide powder.

6. An electrographic processing thermal fixing roll, as recited in claim 5, wherein the silicone rubber consists essentially of thermal vulcanization type HTV silicone rubber.

7. An electrographic processing thermal fixing roll as recited in claim 6, wherein the mixture comprises substantially 100 parts by weight of thermal vulcanization type HTV silicone rubber and 120 parts by weight of silicon carbide.

* * * * *